US007513780B2

(12) United States Patent
Dahms et al.

(10) Patent No.: US 7,513,780 B2
(45) Date of Patent: Apr. 7, 2009

(54) CIRCUIT BOARD CONNECTOR FOR TWO PARALLEL CIRCUIT BOARDS

(75) Inventors: Thomas Dahms, Espelkamp (DE); Guenter Pape, Enger-Poedinghausen (DE)

(73) Assignee: Harting Electronics GmbH & Co., KG (DE)

( * ) Notice: Subject to any disclaimer, the term of this patent is extended or adjusted under 35 U.S.C. 154(b) by 0 days.

(21) Appl. No.: 12/019,580

(22) Filed: Jan. 24, 2008

(65) Prior Publication Data

US 2008/0194125 A1 Aug. 14, 2008

(30) Foreign Application Priority Data

Feb. 8, 2007 (DE) ..... 10 2007 006 204

(51) Int. Cl.
*H01R 12/00* (2006.01)
*H01R 13/28* (2006.01)

(52) U.S. Cl. ..... 439/65; 439/284

(58) Field of Classification Search ..... 439/65, 439/67, 69, 74, 83, 284, 287, 289, 290, 291
See application file for complete search history.

(56) References Cited

U.S. PATENT DOCUMENTS 5,055,054 A * 10/1991 Doutrich ..... 439/66
5,156,553 A * 10/1992 Katsumata et al. ..... 439/62
5,181,855 A * 1/1993 Mosquera et al. ..... 439/74
5,190,474 A * 3/1993 Ginet ..... 439/581
5,498,167 A * 3/1996 Seto et al. ..... 439/74
6,752,637 B2 * 6/2004 Belanger et al. ..... 439/74
7,118,383 B2 10/2006 Nagata et al. ..... 439/63
7,320,605 B2 * 1/2008 Chang et al. ..... 439/74

* cited by examiner

*Primary Examiner*—Chandrika Prasad
(74) *Attorney, Agent, or Firm*—Hayes Soloway P.C.

(57) ABSTRACT

In order to produce a plug-type connection between two circuit boards that are arranged parallel to one another, the invention proposes a coaxially designed connector that is simultaneously realized in the form of a hermaphroditic contact.

This means that only one surface-mountable connector element is required which can be mated with a second connector element of identical design. The two collar-shaped connector elements (1) to be mated can be inserted into one another by means of notches (15, 17) that are provided in the collar (11) for this purpose.

The connector element (1) to be manufactured by means of injection moulding and the MID-technique preferably features a square, collar-shaped base body (10) with an electrically conductive coating and a separate electric signaling contact (40) that is arranged in insulating fashion in a contact holder (30) within the base body (10) such that effective shielding is also realized for the transmission of high frequency signals.

18 Claims, 10 Drawing Sheets

CIRCUIT BOARD CONNECTOR FOR TWO PARALLEL CIRCUIT BOARDS

BACKGROUND OF THE INVENTION

1. Field of the Invention

The invention pertains to a circuit board connector for electrically contacting two parallel, opposing circuit boards that are spaced apart from one another and feature surface-mountable connector elements that engage into one another and feature a mating side and a soldering side.

A connector of this type is required for electrically contacting two circuit boards that are aligned parallel to one another by means of a plug-type connector, wherein the contacting between one circuit board and the other circuit board should take place at arbitrary locations and wherein signals in the GHz range need to be transmitted in interference-proof fashion.

2. Description of the Related Art

Circuit board connectors for a "board-to-board" connection are available in the form of circular individual connectors or oblong series connectors with multiple contacts that are arranged adjacent to one another.

In this context, plug-type connectors with individual contacts are predominantly realized in the form of turned parts, the manufacture of which is relatively expensive.

U.S. Pat. No. 7,118,383 B2 describes a coaxial plug-type connector for connecting two circuit boards, in which two tubular surface-mountable connector elements are mated, wherein a pin-shaped central contact of one connector element engages into a U-shaped mating contact of the other connector element.

SUMMARY OF THE INVENTION

The invention therefore is based on the objective of designing a circuit board connector of the initially described type in such a way that an electric connection compatible with high frequencies can be produced between two circuit boards with the aid of a compact connector element, wherein each connector element should be connected to the circuit board in surface-mounted fashion.

This objective is attained in that the connector element features a multilateral symmetric, collar-shaped base body, in that notches are provided in two opposite corner regions of the base body, namely a first corner region and a second corner region, and in that a contact holder for at least one electric signaling contact pointing toward the center of the base body is provided within the base body in a third corner region between the two notches.

The advantages attained with the invention can be seen, in particular, in that a high frequency-proof plug-type connection that is suitable for use up to the GHz range can be produced by means of the collar-shaped structure of the connector element, in the interior of which an electric contact is arranged in insulated fashion.

In this case, the connector element is preferably realized in the form of a square hermaphroditic connector part, i.e., it can be mated with a connector part of identical design.

However, it would also be conceivable to realize other multilateral connector elements that have a symmetric shape.

The base body of the connector element consists of insulating material and is completely surrounded by an electrically conductive coating.

An electrically insulating contact holder with an electric contact anchored therein is arranged in the interior of the base body, wherein the electric contact is realized in the form of a separate component that can be inserted into the base body by means of interacting snap-in means.

With respect to thermal considerations, the base body and the contact holder are advantageously made of the same insulating material.

A corresponding arrangement of the soldering surfaces is provided on the circuit boards such that the electrically conductive coating of the connector element and the signaling contact accordingly contact separate soldering surfaces.

In one variation, the base body of the connector element is provided with an electrically conductive coating in important sections, preferably in the inner region.

In this case, the contact holder is directly moulded into the base body—without electrically conductive coating.

The only additional component required is the inner electric contact that is realized in the form of a punched and bent part.

In order to achieve a shielded signal transmission capable of high frequencies, it is sensible to realize the two connector elements such that they can be mated and a labyrinth seal of sorts is optimally produced. To this end, the collar-shaped base body is provided with notches on two opposite corner regions so as to make it possible to interconnect the two identical connector elements. In this case, one connector element is axially turned by 180°—slightly offset laterally referred to the other connector element—during the mating process.

In addition, a suction surface is advantageously provided on the mating side of the contact holder that accommodates the electric contact, namely in the corner region enclosed by the two notches, wherein said suction surface makes it possible to insert the connector element on a circuit board by means of an automatic insertion machine.

As mentioned above, at least the inner region is coated in electrically conductive fashion by means of the MID-technique except for the insulating region of the electric contact. This also applies to the two notches and the peripheral collar edge with funnel-shaped bevels, as well as to the collar edge that points to the circuit board and in which bores are advantageously provided, wherein said bores exert a capillary effect upon the soldering means introduced between the connector element and the circuit board and thusly ensure that a reliable soldered connection is produced.

The peripheral collar edge on the mating side advantageously features bevels that promote and simplify the "capture" of two connector elements to be mated, wherein misalignments in the Z-axis or relative horizontal rotations of up to ±10° are tolerable for a connector pair.

However, the "capture" of the mating connector can still be realized at a vertical incline of the Z-axis of 7°.

A tolerance of ±0.75 mm is provided for the mated state in the Z-axis, i.e., the vertical spacing between two circuit boards.

Since the connector elements are manufactured in the form of injection-moulded plastic parts, a graduated spacing of approximately 6-30 mm is provided between two circuit boards.

Spacings of 6.7 mm, 19 mm and 28.7 mm are preferably provided. Although intended as a signaling contact, it would also be conceivable to realize a variation in the form of a so-called power contact if the connector element and the signaling contact have corresponding dimensions, wherein it would also be possible to realize a variation without the inner signaling contact.

It is also possible to arrange multiple contacts that are advantageously realized in the form of hermaphroditic contacts and feature a straight contact limb and an S-shaped contact limb within the base body such that two differently shaped contact limbs respectively contact one another during the contacting of two correspondingly equipped connector elements.

BRIEF DESCRIPTION OF THE DRAWINGS

One embodiment of the invention is illustrated in the figures and described in greater detail below. The figures show.

DESCRIPTION OF THE PREFERRED EMBODIMENTS

Figure 1:
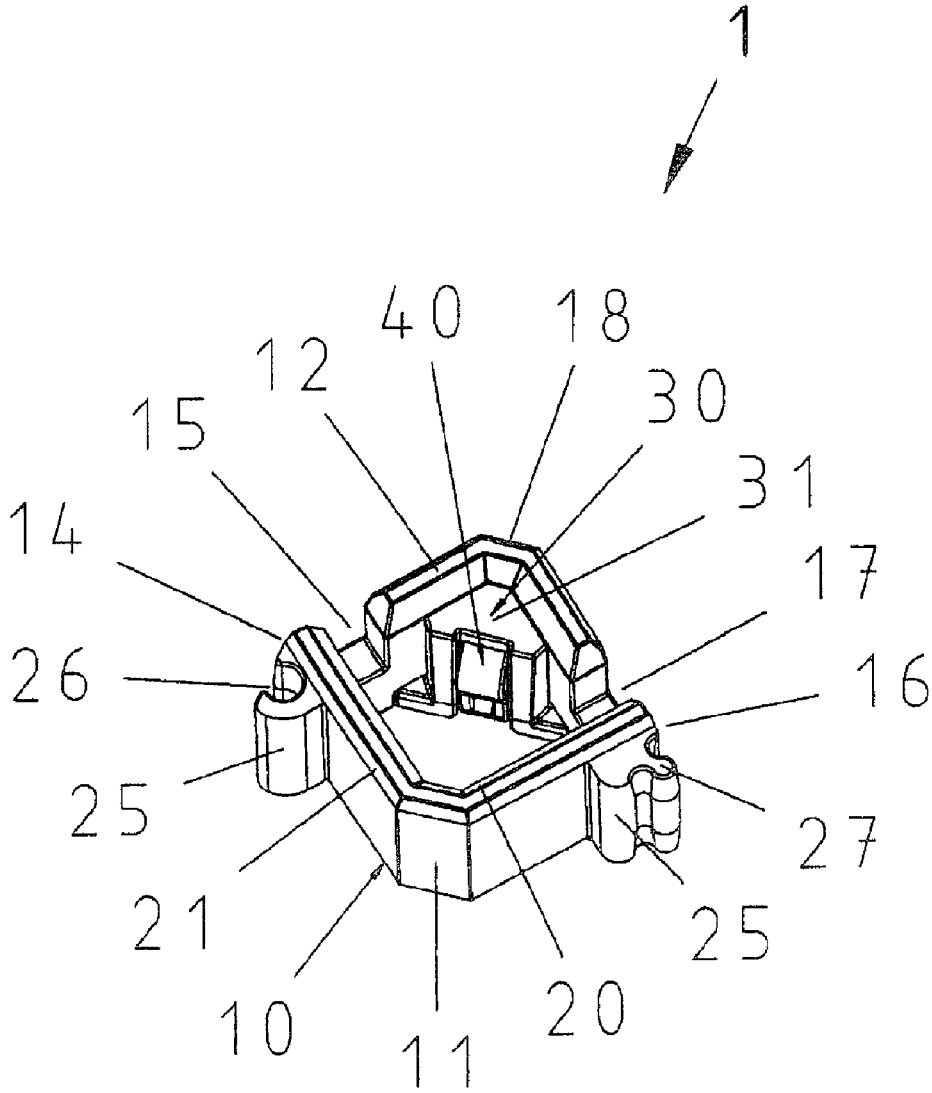
FIG. 1 is an isometric representation of the mating side of a connector element.

FIG. 1 shows an isometric representation of a one-piece collar-shaped connector element with a view of the mating region.

The connector element 1 is realized in the form of a square, collar-shaped base body 10, wherein notches 15, 17 are provided in two opposite corner regions 14, 16 such that they respectively extend perpendicular to the collar 11.

The entire base body 10 is coated with an electrically conductive coating.

The notches 15, 17 approximately have a width that corresponds to the thickness of the collar and are illustrated with a depth that approximately corresponds to half the height of the overall collar height.

A contact holder 30 of insulating material is inserted into the base body 10 in the corner region 18 enclosed by the two notches 15, 17, wherein said contact holder serves for accommodating an electric signaling contact 40 that is realized in the form of an individual contact in this case.

Toward the mating side, the contact holder 30 features a triangular suction surface 31 that serves as a so-called pick-and-place point and thusly makes it possible to insert the connector element on a circuit board in machine-controlled fashion.

On the mating side, the collar 11 features a collar edge 12 with peripheral bevels 20, 21 toward the inside and the outside such that the mating of two identical connector elements is promoted and simplified.

In addition, outwardly acting side-by-side mounting elements realized in the form of a tongue 27 and a groove 26 are moulded onto the corner regions 14, 16. In this case, the tongue 27 is realized in the shape of a barrel with tapered outer regions such that, when connecting several connector elements in a row, the tongue initially can be easily inserted into the groove until the thicker central region of the tongue-and-groove combination produces a positive connection. In this context, it should be noted that the groove 26 is also realized barrel-shaped in the longitudinal direction and features widening outer regions.

Figure 2:
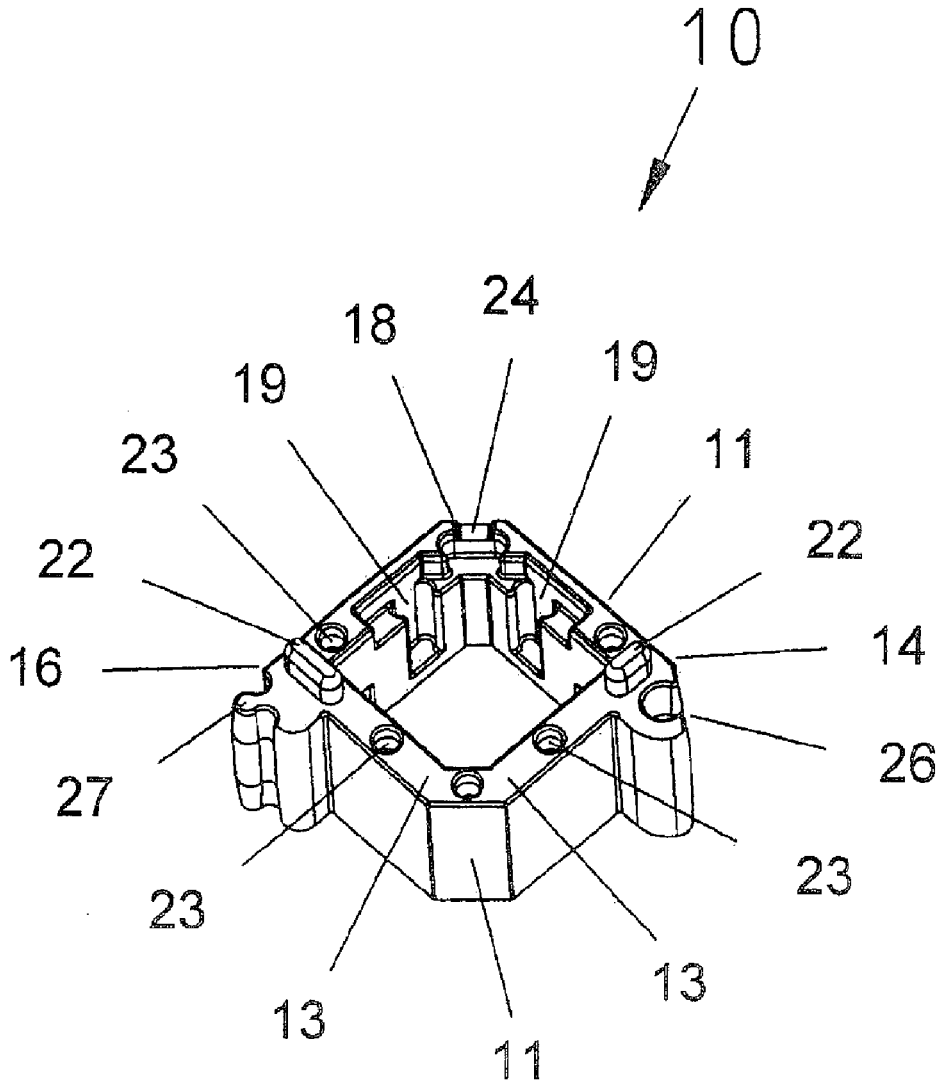
FIG. 2 is an isometric representation of the soldering side of the base body of the connector element.

FIG. 2 shows the square base body 10 of the connector element with a view of a soldering side.

The significant aspects of this figure are the two T-shaped recesses 19 in the two collar sides 11 that form the corner region 18. The contact holder 30 is inserted at this location and held by means of corresponding projecting snap-in rails 32.

In addition, the corner region features a groove 24, into which an integral soldering tag 42 of the signaling contact can be inserted in order to realize the soldering on the soldering pad of a circuit board.

Two fixing pins 22 are integrally moulded onto the collar edge 13 on the soldering side, wherein said fixing pins serve for polarizing and holding the connector element on a circuit board until the soldering means finally fixes the connector element as it ascends in the bores 23 provided in the collar edge during the soldering process due to capillary forces 10.

Figure 3A:
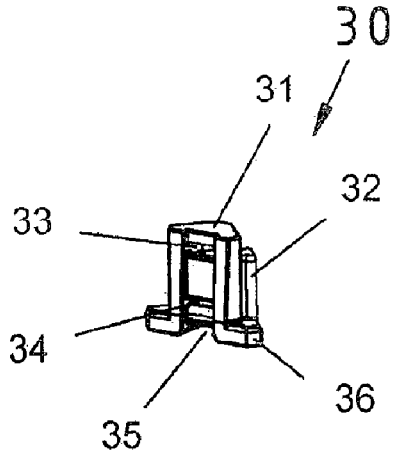
FIG. 3*a* is an isometric representation of a contact holder of the connector element.
Figure 3B:
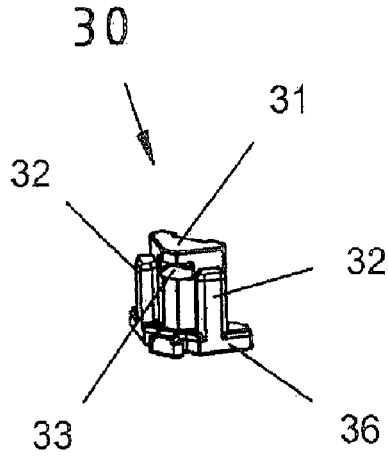
FIG. 3*b* is a representation of the contact holder with a view of the corner region.
Figure 3C:
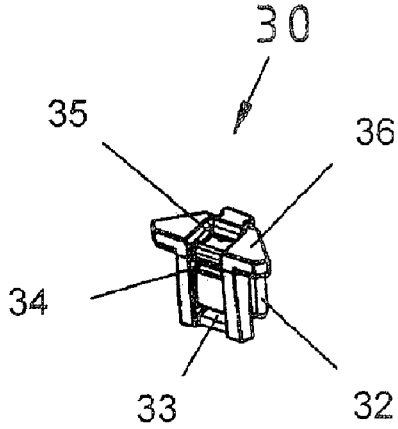
FIG. 3*c* is a representation of the contact holder with a view of the base region.

FIGS. 3*a*, 3*b*, 3*c* show several representations of the contact holder 30, into which the signaling contact 40 is inserted.

In this case, FIGS. 3*a* and 3*b* show an upright position and FIG. 3*c* shows a reversed position.

The horizontal projection has the shape of a triangular leg 36 in accordance with the insertion into the corner region 18 and a height that, according to the wall height of the base body 10, extends no further than the inner bevel 20.

The upper smooth triangle serves as the suction area 31 for the machine-controlled insertion of the entire connector element on a circuit board.

A column-like structure is illustrated in the center, wherein an opening 33 is realized at the top of the recess between the two columns and a depression 34 is arranged in the lower region and a pocket 35 is arranged at the base of said recess. The contact holder is fixed in the T-shaped recesses 19 in the base body 10 by means of the projecting, vertically extending snap-in rails 32.

Figure 4A:
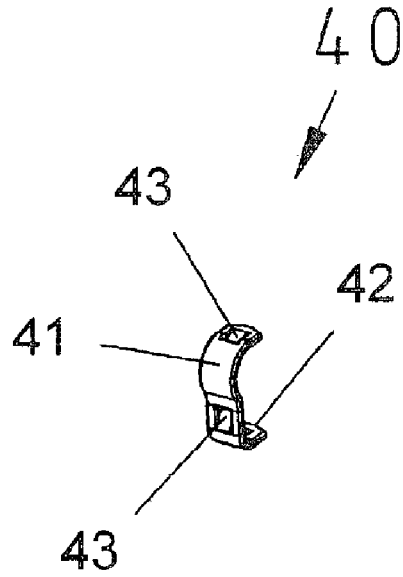
FIG. 4*a* is a representation of the outside of an electric contact.
Figure 4B:
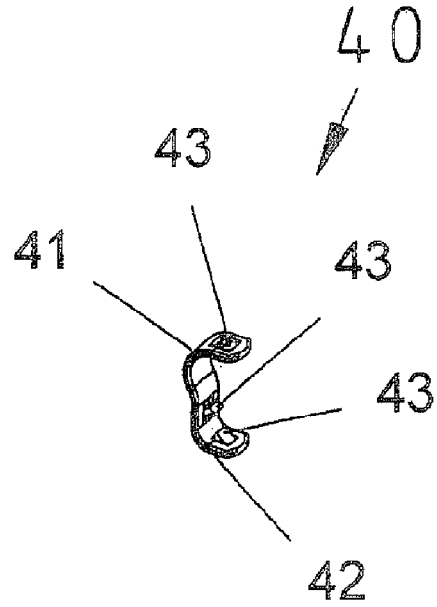
FIG. 4*b* is a representation of the inside of the electric contact.

The signaling contact 40 shown in FIGS. 4*a*, 4*b* has the shape of an U with a contact region 41 that is bent outward and a flat soldering tag 42.

Snap-in hooks 43 are respectively cut out on three sides and bent outward at three locations, namely in the upper limb end, in the lower limb end and underneath the bent contact region. The signaling contact is snapped into the opening 33, the depression 34 and the pocket 35 by means of these snap-in hooks.

Figure 5:
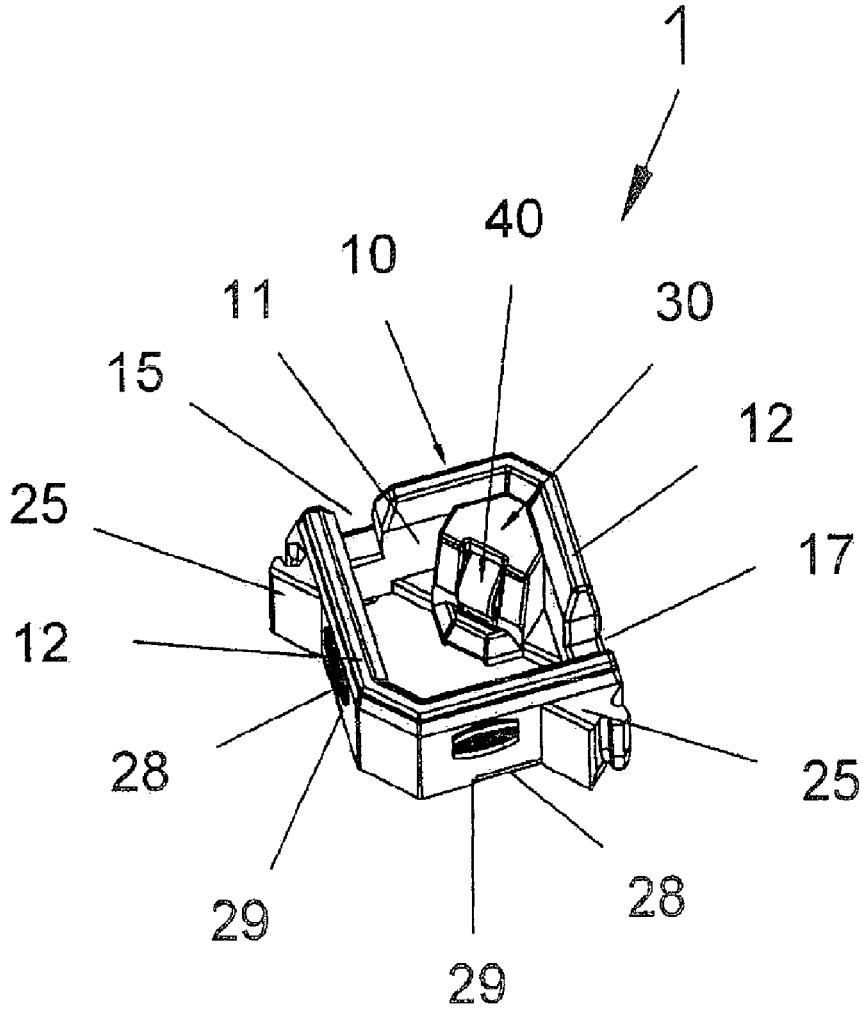
FIG. 5 is a variation of the connector element.

FIG. 5 shows a variation 1' of the connector element 1, in which an electrically conductive coating is only provided on the inside and the outside of the inner walls and the collar edge 12 on the mating side that is realized with different angles in order to achieve an optimal high frequency shielding effect when the connector elements are completely mated. In this respect, the insulating contact holder 30 for the signaling contact 40 is also directly moulded into the base body. The electric coating is not specially illustrated.

Figure 6A:
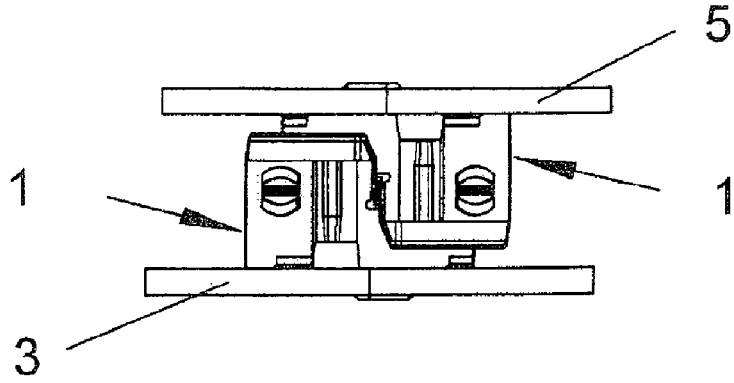
FIG. 6*a* are two short connector elements in the mated state.

FIG. 6*a* shows two connector elements 1 or 1' that are respectively mounted on a circuit board 3, 5 and contact one another. In this case, the upper connector element shown on the circuit board 5 is turned by 180°. The diagonal notches 15, 17 in the collar 11 make it possible to completely insert the two base bodies into one another in slightly offset fashion, wherein the shielding coatings of the collar walls are initially contacted until the two inner signaling contacts finally contact one another shortly thereafter.

Figure 6B:
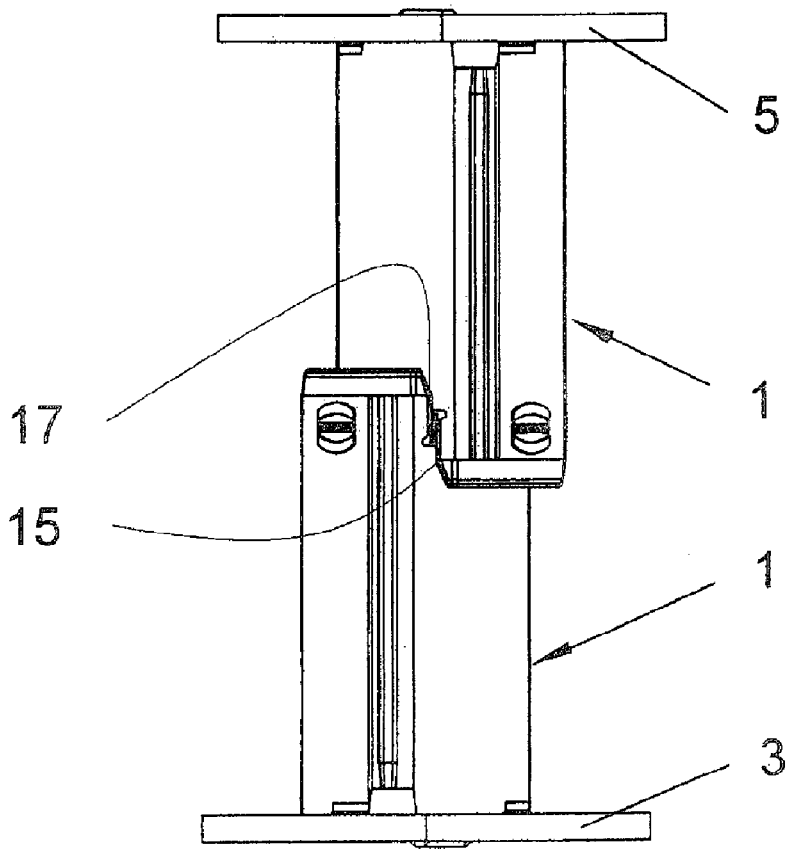
FIG. 6*b* are two long connector elements in the mated state.

According to FIG. 6*b*, different heights or different spacings between the circuit boards can be realized relatively easily with connector element variations that have different heights. In this respect, circuit board spacings of approximately 6-30 mm are provided. The extension is only provided for the central region of the base body while the configuration for the two collar edges on the mating side and the soldering side remains unchanged.

This requires a corresponding extension of the signaling contact and therefore also an extension of the contact holder.

Figure 7:
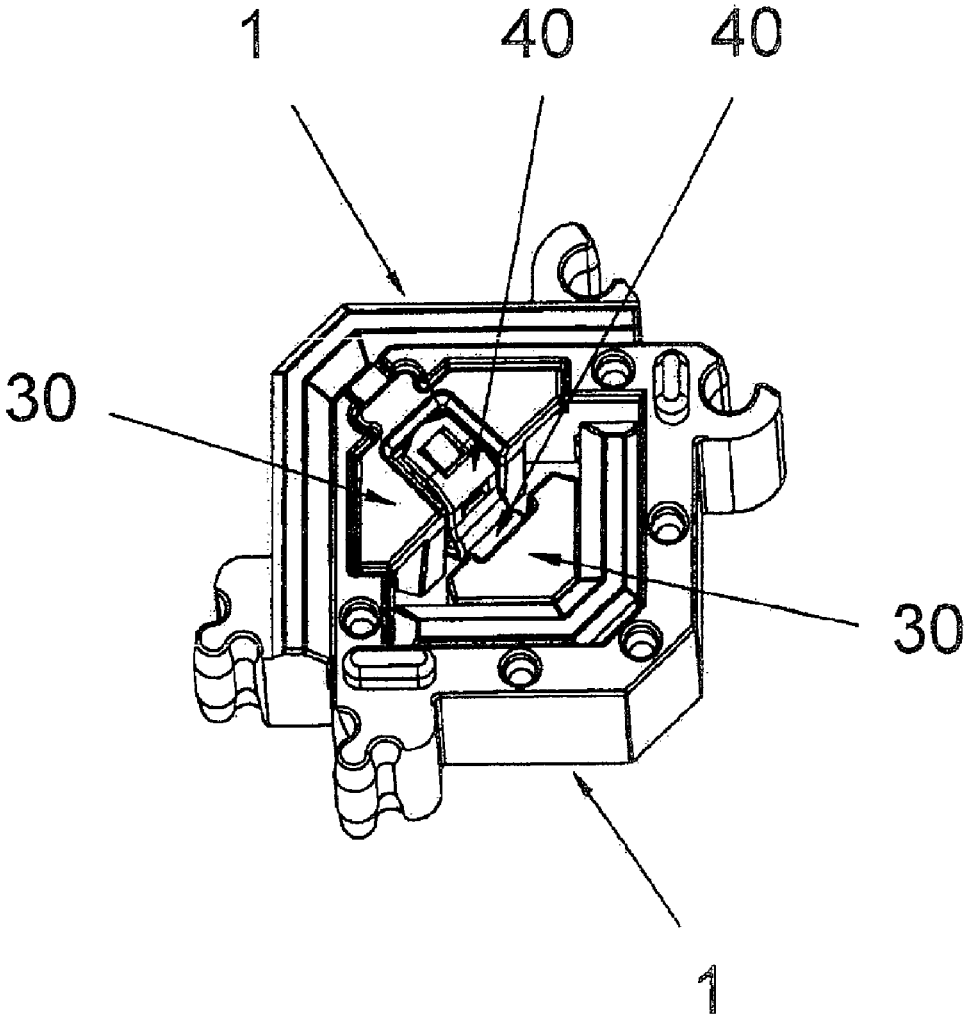
FIG. 7 are two connector elements without circuit boards in the mated state.

FIG. 7 shows two mated connector elements 1, wherein the upper circuit board is removed.

This figure clearly shows the contacting of both signaling contacts 40, the outwardly bent contacting region 41 of which generates a diagonal force component such that the base bodies 10 of the connector elements are always pushed into the opposing corner regions and thusly ensure the reliable contacting of the coating for the transmission of the ground signal.

Figure 8:
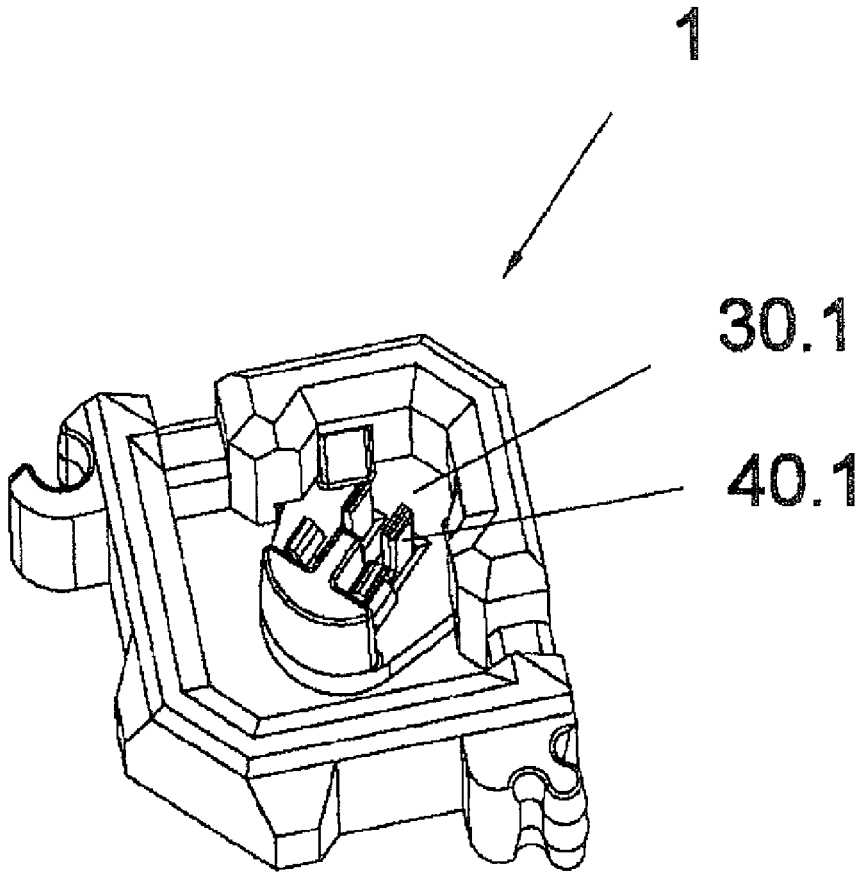
FIG. 8 is a connector element with multiple contacts.

FIG. 8 shows a variation of the previously described connector element 1 which is shown with a multiple contact 40.1 arranged in a contact holder 30 within the base body 10.

Figure 9A:
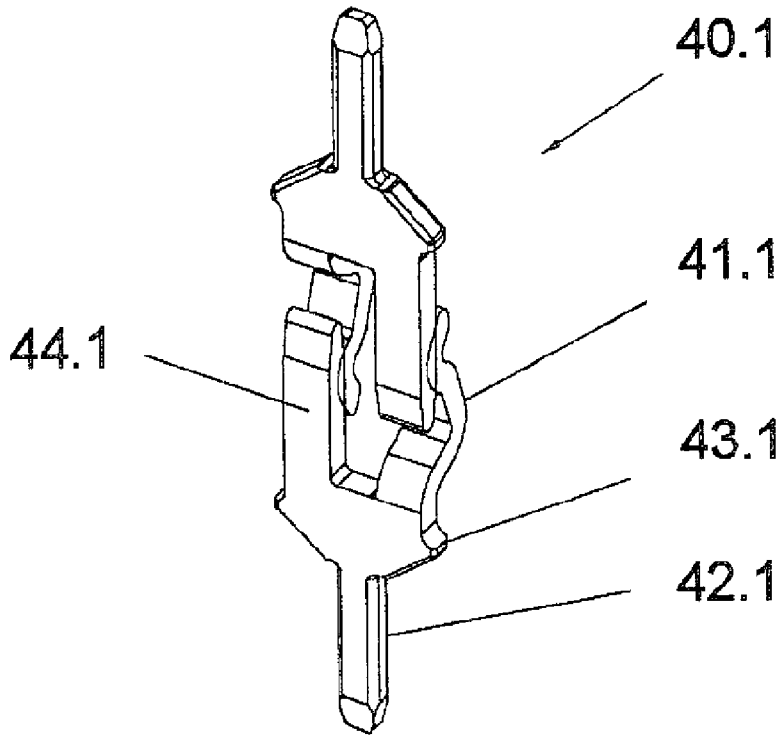
FIG. 9*a* is a hermaphroditic contact element with a soldering tag.

In this case, the multiple contact 40.1 shown in FIG. 9*a* is realized in the form of a hermaphroditic contact element with two interconnected contact limbs—a straight, flat contact limb 44.1 and an approximately S-shaped contact limb 41.1 that can be inserted into a corresponding bore of the circuit board together with a soldering tag 42.1.

Figure 9B:
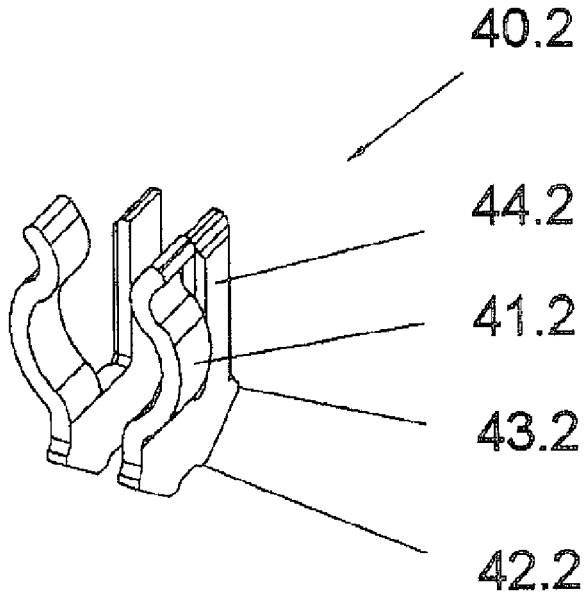
FIG. 9*b* is a hermaphroditic contact element without a soldering tag.

In this respect, a surface-mountable version of a multiple contact according to FIG. 9*b* is also provided.

Figure 10:
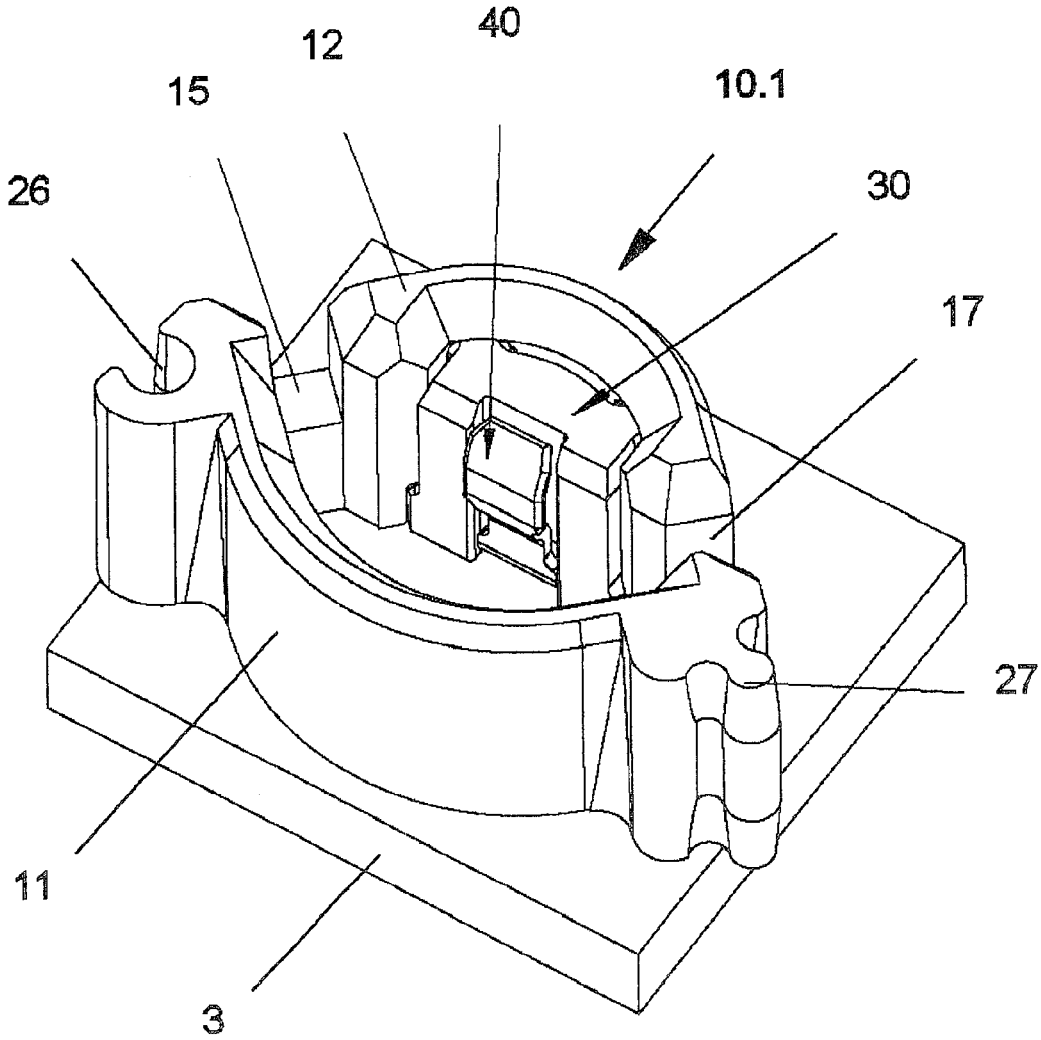
FIG. 10 is a variation of an oval connector element.

Lastly, FIG. 10 shows a variation of a connector element 1 with a section of a circuit board 3, wherein the connector element features a base body 10.1 of oval shape, in which the signaling contact 40 is held by means of the contact holder 30.

What is claimed is:

1. A circuit board connector for electrically contacting two parallel, opposing circuit boards that are spaced apart from one another and feature surface-mountable connector elements that engage into one another and feature a mating side and a soldering side, wherein the connector element features a multilateral symmetric, collar-shaped base body, in that notches are provided in two opposite corner regions of the base body, namely a first corner region and a second corner region, and wherein a contact holder for at least one electric signaling contact pointing toward the center of the base body is provided within the base body in a third corner region between the two notches.

2. The circuit board connector according to claim 1, wherein one connector element can be mated with another connector element.

3. The circuit board connector according to claim 1, wherein the base body is provided with an electrically conductive coating.

4. The circuit board connector according to claim 1, wherein the contact holder is realized in the form of a separate component and can be fixed in the third corner region by snap-in rails that engage into recesses in the base body.

5. The circuit board connector according to claim 1, wherein the width of the notches at least corresponds to the wall thickness of the base body.

6. The circuit board connector according to claim 1, wherein the collar edge of the base body on the mating side features inner bevels and outer bevels with different inclinations.

7. The circuit board connector according to claim 1, wherein the mounting of the base body on a circuit board is realized with a suction area provided on the contact holder for a machine-controlled insertion.

8. The circuit board connector according to claim 1, wherein the base body features collars of different heights in order to realize different spacings between two circuit boards.

9. The circuit board connector according to claim 1, wherein the base body features several bores in its collar edge on the soldering side.

10. The circuit board connector according to claim 1, wherein at least one fixing pin is moulded onto the collar edge of the base body on the soldering side.

11. The circuit board connector according to claim 1, wherein a tongue-and-groove connection is realized on the opposing first and second corner regions in order to combine or arrange several connector elements in a row.

12. The circuit board connector according to claim 11, wherein the tongue-and-groove connection respectively has the shape of a barrel in the longitudinal direction, wherein the groove features outer regions that widen in funnel-shaped fashion and the tongue features tapered outer regions on both sides.

13. The circuit board connector according to claim 1, wherein one variation of the connector element features an electrically conductive coating that is applied onto the inner side of the base body and extends over the collar edge on the mating side.

14. The circuit board connector according to claim 13, wherein the variation of the connector element is provided with soldering pads in sunken recesses on the collar edge of the base body on the soldering side, wherein said soldering pads are connected to the electrically conductive coating.

15. The circuit board connector according to claim 1, wherein the electric contact is realized in the form of an individual contact or a multiple contact that is respectively provided with a soldering tag.

16. The circuit board connector according to claim 15, wherein the multiple contact is realized in hermaphroditic fashion in the form of a forked element, wherein a straight contact limb is arranged such that it is laterally spaced apart from a S-shaped contact limb, and wherein the respective contact limb of different shape is contacted during the mating process.

17. The circuit board connector according to claim 15, wherein several individual contacts and/or multiple contacts are arranged within a correspondingly shaped base body.

18. The circuit board connector according to claim 15, wherein the electric contact is realized in the form of a surface-solderable contact.

* * * * *